US005704484A

United States Patent [19]

Spinks et al.

[11] Patent Number: 5,704,484

[45] Date of Patent: Jan. 6, 1998

[54] PROTECTIVE BOTTLE JACKET

[75] Inventors: Thomas L. Spinks; Russell L. Bromley, both of Muskegon; James T. Przybytek, Fruitport, all of Mich.

[73] Assignee: Allied Signal Inc., Morris Township, N.J.

[21] Appl. No.: 684,316

[22] Filed: Jul. 18, 1996

Related U.S. Application Data

[63] Continuation of Ser. No. 304,109, Sep. 9, 1994, abandoned.

[51] Int. Cl.[6] ..... B65D 21/00

[52] U.S. Cl. ..... 206/521; 215/12.1; 220/410; 220/742

[58] Field of Search ..... 220/410

[56] References Cited

U.S. PATENT DOCUMENTS

| | | | |
|---|---|---|---|
| 942,141 | 12/1909 | Hoffman | 215/332 |
| 2,122,746 | 7/1938 | Kernahon | 220/298 X |
| 2,675,070 | 4/1954 | Raun et al. | 220/298 |
| 3,979,011 | 9/1976 | Schleicher | 220/742 |
| 4,223,827 | 9/1980 | Gilbert | 206/521 |
| 4,300,612 | 11/1981 | Schroeder, Jr. et al. | 215/12.1 X |
| 4,373,641 | 2/1983 | Banich, Sr. et al. | 215/332 X |
| 4,438,856 | 3/1984 | Chang | 215/12.1 |
| 4,982,869 | 1/1991 | Robbins, III | 220/742 X |
| 5,085,340 | 2/1992 | Doxey et al. | 220/298 |
| 5,213,215 | 5/1993 | Preuot | 206/521 X |

FOREIGN PATENT DOCUMENTS

| | | |
|---|---|---|
| 1 251 744 | 3/1989 | Canada . |
| 396 999 | 11/1909 | France . |
| 2 476 606 | 8/1981 | France . |
| 2 597 440 | 10/1987 | France . |
| 1 486 239 | 1/1969 | Germany . |
| 9419247 | 9/1994 | WIPO . |

OTHER PUBLICATIONS

"Safety/Chemical Handling & Storage"; Scientific Products; Date unknown, p. 1702.

"Bottle Carriers/Bottles/Containers"; Lab Safety Supply; Date unknown, p. 639.

*Primary Examiner*—Jimmy G. Foster

*Attorney, Agent, or Firm*—Lois A. Gianneschi; Jay P. Friedenson

[57] ABSTRACT

A protective bottle jacket for transporting a container, bottle or the like is provided. The protective jacket has a bottom portion having a base and walls projecting upwardly from the base for receiving and protecting the bottom portion of the container and a top portion having walls for covering the top portion of the container. The protective jacket has means for selectively and releasably interlocking the bottom and top portions together. The interlocking means comprises a male member disposed on one of the bottom and top portions and a passage disposed on the other of the bottom and top portions for slidably receiving the male member between an unlocked and locked position in response to rotation of the top and bottom jacket portions, wherein the passage lockably receives the male member and attaches the top and bottom portions together in the locked position and wherein the male member does not lockably engage the passage in the unlocked position. The protective jacket also has a handle assembly for transporting the jacket and bottle. The handle assembly has top and bottom handle portions attached to the top and bottom portions of the jacket respectively, such that the top and bottom handle portions operatively engage each other only when the interlocking means is in the locked position.

28 Claims, 6 Drawing Sheets

PROTECTIVE BOTTLE JACKET

This is a continuation of application Ser. No. 08/304,109 filed on Sep. 9, 1994, now abandoned.

FIELD OF THE INVENTION

The present invention relates generally to a shatter-resistant safety enclosure for fragile bottles made from glass, ceramic and the like, which typically contain hazardous materials such as toxic, caustic or flammable liquids.

BACKGROUND OF THE INVENTION

Containers made from glass, ceramic and the like are typically used to store and transport hazardous chemical materials including toxic, caustic or flammable liquids and the like. Since large volumes are commonly necessary, a common container is the four liter glass bottle. Although the glass container is essential to preserve the integrity of the contents, the fragility and potential hazard from accidental breakage is of great concern to most users since breakage of a container of hazardous material can lead to exposure of workers to toxic or caustic fumes or liquids as well as create a substantial possibility of fire in the case of flammable materials.

One means used for the protection of glass bottles utilizes an integral coating applied to the exterior of the bottle. In one type of integral coating process, a solvent-soluble material, such as polyvinyl chloride, is applied to the bottle by a dipping process. Unfortunately, use of the material can subsequently lead to contamination of the bottle interior or destruction of the coating material by dripping of the bottle's contents during use.

In another integral coating process, a solvent-resistant material is applied to the bottle in a heating process. Since many types of flammable liquids cannot be heated, this process requires an empty bottle and, thus, eliminates the advantage of applying the coating protection to a filled container. This heat-coating process can also lead to internal contamination of the bottle itself during the coating process. The heat-coating process is also inapplicable to some types of bottles, for example, those that cannot stand the shock of the rapid heating and cooling demanded by the process.

Another means for protecting the bottle utilizes a pre-molded plastic pail-type cover or container. One type of container uses a heavy, pre-molded plastic container with a snap down lid. U.S. Pat. No. 4,300,612 (Schroeder, Jr., et al.) discloses another pail-type container which utilizes a top and bottom portion which are threadedly attached to each other. These protective containers are only effective when they are properly assembled to enclose the exterior of the bottle.

Unfortunately, previous pail-type containers have many disadvantages and problems. The shape and configuration of many containers are such that they are heavy, ungainly, and require significant storage space. Similarly, they are not designed for use during the shipment of hazardous materials. The configuration of the containers causes the assembly and disassembly of the protective containers to be relatively difficult and time-consuming, thus discouraging the proper use of the containers. Many bottle containers are also opaque, requiring removal of the container for identification or inspection of the bottle, or examination of the liquid level, again, defeating the purpose of the container.

The configuration of the handles on previous protective containers is another source of problems. In protective containers which use non-integral handles, attaching the handles to the containers has been relatively difficult, again discouraging the proper use of the container. Protective containers which use handles integrally attached to the bottom portion of the container permit the bottle and the hazardous material to be stored, transported and dispensed without use of the top cover, thus defeating the purpose of the safety containers.

OBJECTS AND SUMMARY OF THE INVENTION

It is an object of the present invention to provide a novel and improved protective safety jacket for use with fragile bottles, containers and the like made from fragile materials such as glass, ceramic or the like.

It is another object of the present invention to provide a protective safety jacket which is easily assembled and disassembled, thus promoting use of the bottle jacket.

A related object is to provide a safety jacket having a simple and easily assembled interlocking mechanism which insures positive engagement between the top and bottom portions of the safety jacket.

It is also an object of the present invention to provide a safety jacket having a handle which can only be utilized when the safety jacket is properly assembled.

A related object is to provide a handle which insures positive engagement of the top and bottom portions of the bottle cover.

Yet another object of the present invention is to provide a transparent or translucent safety jacket permitting the bottle label and liquid level to be viewed through the jacket walls.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 1:
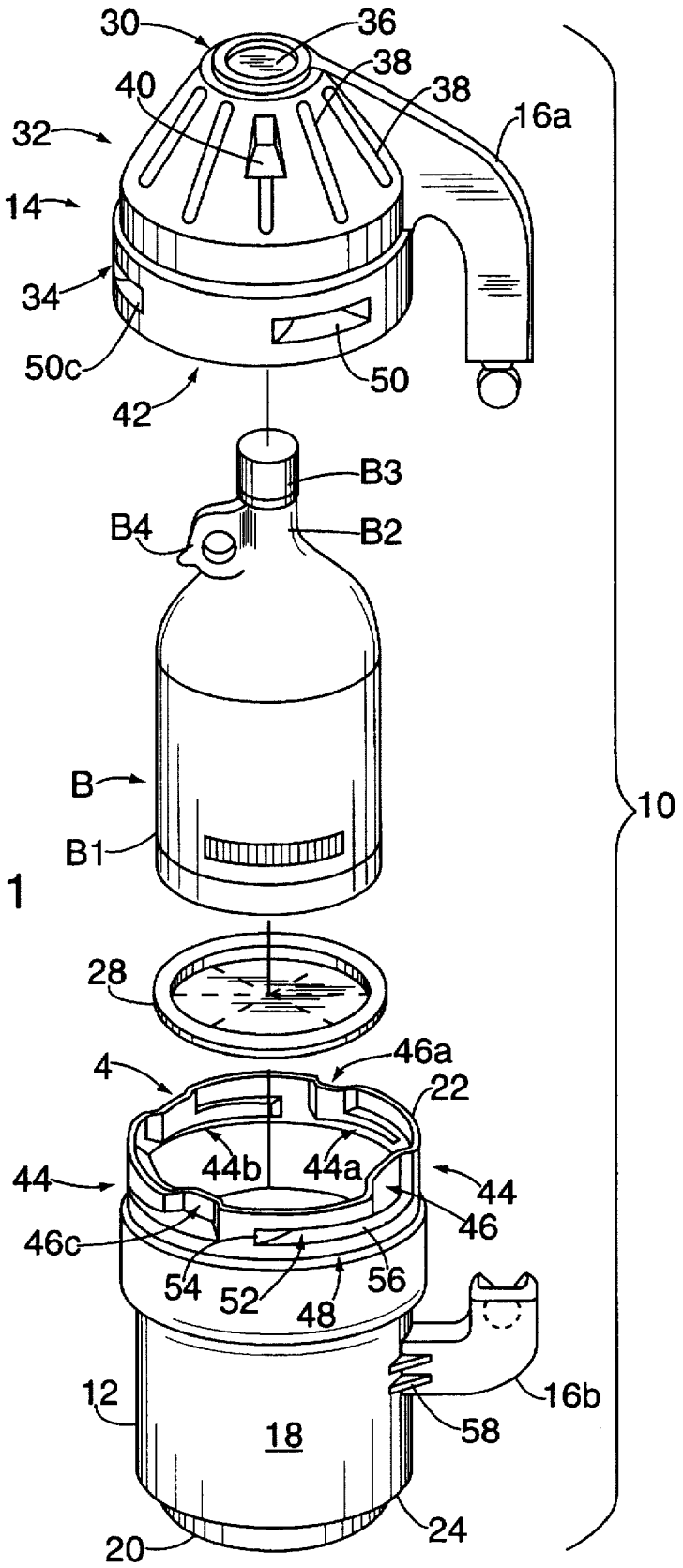
FIG. 1 is an exploded view of one embodiment of a protective safety jacket in accordance with the present invention and a common four liter bottle container.
Figure 2:
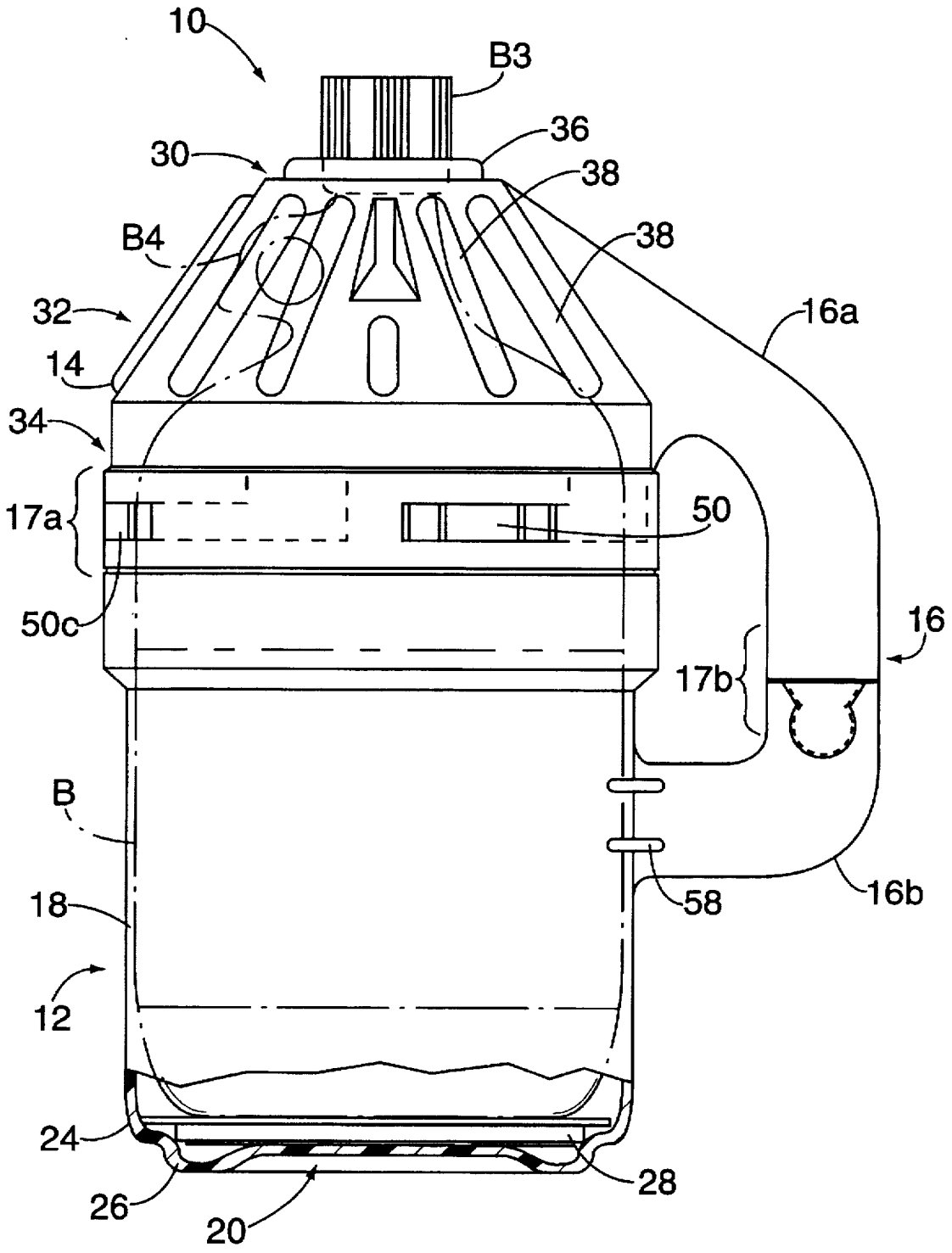
FIG. 2 is an elevational view of the assembled protective bottle jacket containing the bottle.
Figure 3:
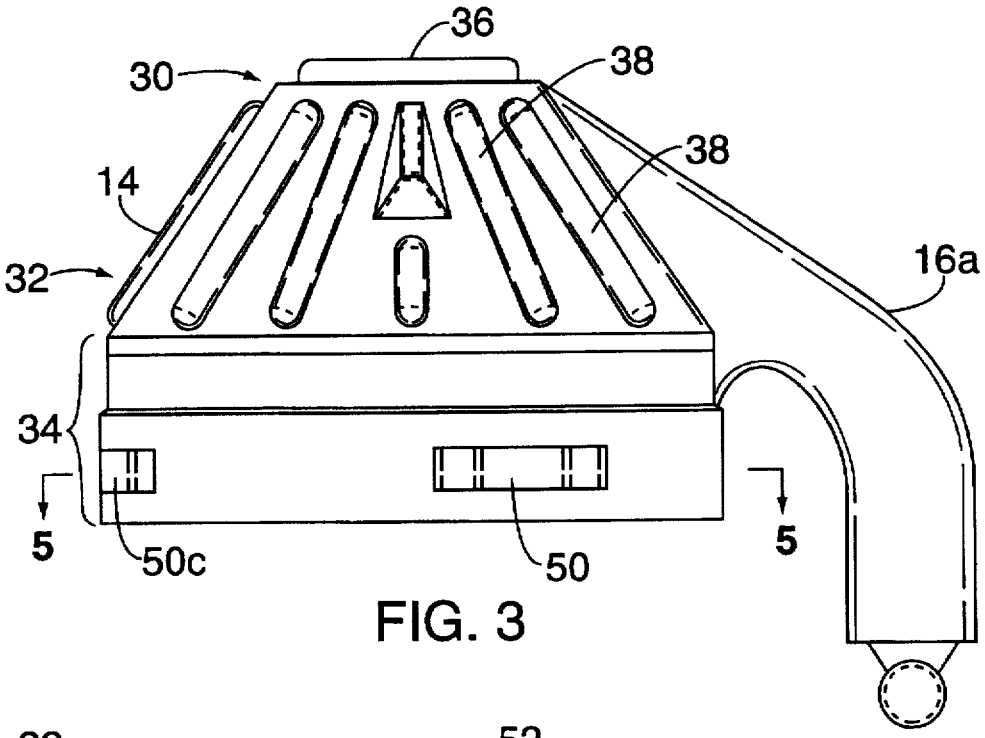
FIG. 3 is an elevational view of the top portion of the protective jacket.

Referring to the figures and particularly to FIGS. 1–2, one embodiment of a protective safety jacket 10 in accordance with the present invention is illustrated for receiving a conventional bottle B typically used for storing and transporting liquid chemicals and the like. The illustrated bottle B is a common four liter bottle which typically has a cylindrical body B1 which narrows to a neck B2 and a bottle cap B3 covering an opening (not shown). Some types of bottle B will have a finger handle B4. It will be understood that the safety jacket may be sized to accommodate any size or shape bottle.

The protective bottle jacket 10 comprises a bottom portion 12, a top portion 14, an interlocking mechanism for providing secure engagement between the bottom and top portions 12, 14, generally depicted as 17, and a handle 16 defined by top and bottom handle portions 16*a*, 16*b*.

The bottom portion 12 of the protective jacket 10 has a wall 18 projecting upwardly from a base 20, which generally define a cylindrical body adapted to receive the cylindrical body B1 of the bottle B. An upper circumferential edge, generally designated as 22 is adapted to lockably engage the top portion 14 of the jacket 10. It is preferable that the internal configuration of the bottom portion 12 closely conform to the exterior shape and dimensions of the bottle B for providing secure containment of the bottle within the bottom portion 12. Thus, movement of the bottle B within the protective jacket 10 is minimized or eliminated during transport or when the jacket 10 and the bottle B are tilted to dispense the contents of the bottle B. In addition, little space is needed over that required for the protected bottle B itself, and therefore, there would be no need for change in carton size, an advantage to users having storage facilities designed for cartons currently in use.

Figure 4:
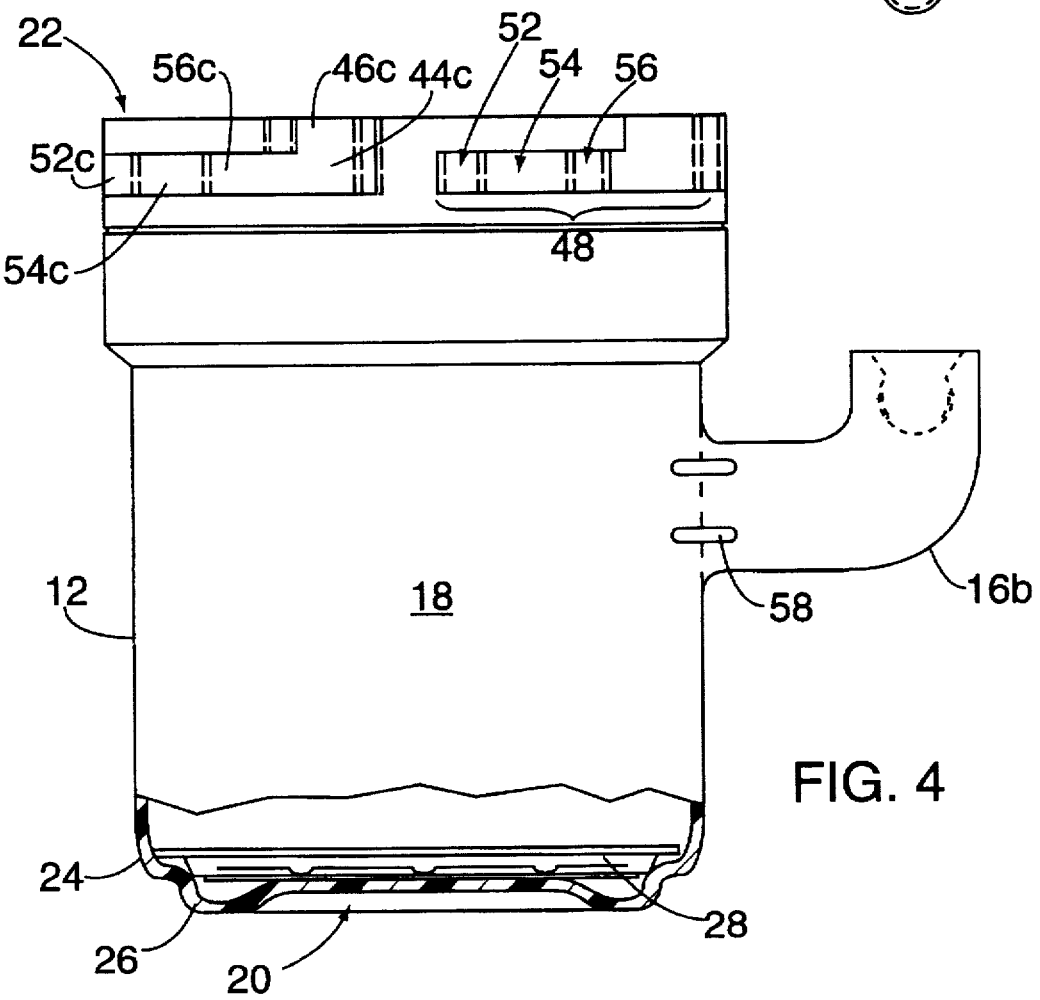
FIG. 4 is an elevational view of the bottom portion of the protective jacket.

In the illustrated embodiment, the base 20 has a broad, substantially flat surface which is slightly spaced inboard of the wall 18 as best shown in FIGS. 2 and 4. The periphery of the base 20 is generally defined by channeled edges 24, 26 which provide reinforcement for accommodating the forces and loads exerted on the bottom portion 12 of the protective jacket 10.

The base 20 may be adapted to receive an insert, generally depicted as 28, which is adapted to be interposed between the bottle B and the base 20 of the bottom portion 12. The presence of the insert 28, the inboard configuration of the base 20, and the presence of the channeled edges 24, 26 of the base 20 act to space the bottle B from direct contact with the base 20, minimizing or eliminating the effect of sharp forces exerted on the exterior of the protective jacket 10 when the protective jacket 10 (and the bottle B contained therein) is transported or rested upon a surface. In addition, the insert 28 acts to disperse the load of the bottle B along the entire surface of the base 20, minimizing stress points to the protective jacket 10 and preventing damage thereto.

The configuration of the top portion 14 of the protective jacket 10 is adapted to conform to the shape of the upper part of the bottle B. In the illustrated embodiment, the top portion 14 has a generally conical shape which, for ease of reference, generally defines top, middle and bottom sections 30, 32, 34, respectively. The top section 30, which is adapted to cover and protect the neck B2 and top of the protected bottle B, has an opening 36 for receiving the bottle neck B2, opening 36 and cap B3, providing access to the contents of the bottle B without having to disassemble the protective jacket 10. Similarly, the bottle B may be filled or emptied without removing the protective jacket 10. The top section 30 of the top portion 14 may also be adapted to threadably receive an enclosure cap (not shown) to cover the opening 36.

In the illustrated embodiment, the middle section 32 of the top portion 14 generally tapers outwardly from the top section 30 to the bottom section 34. The middle section 32 has a plurality of longitudinal ribs 38 or corrugations for reinforcement. The middle section 32 also has at least one (only one is shown), and preferably a pair of opposing members 40 which protrude inwardly for engaging the finger handle B4 and thereby limiting rotation of the bottle B within the protective jacket 10.

The bottom section 34 of the top portion 14 is adapted for rotatably engaging the bottom portion 12. The bottom section 34 has a circumferential edge 42 adapted to rotatably engage the circumferential edge 22 of the bottom portion 12.

The protective jacket 10 has means for selectively and releasably interlocking the bottom and top portions 12, 14 of the protective jacket 10 together. In the illustrated embodiment, the interlocking means 17 comprises a jacket interlocking mechanism, generally depicted as 17*a*, for releasably interlocking the bottom and top portions 12, 14 together and a handle interlocking mechanism 17*b* for releasably interlocking the top and bottom handle portions 16*a*, 16*b*.

Figure 5:
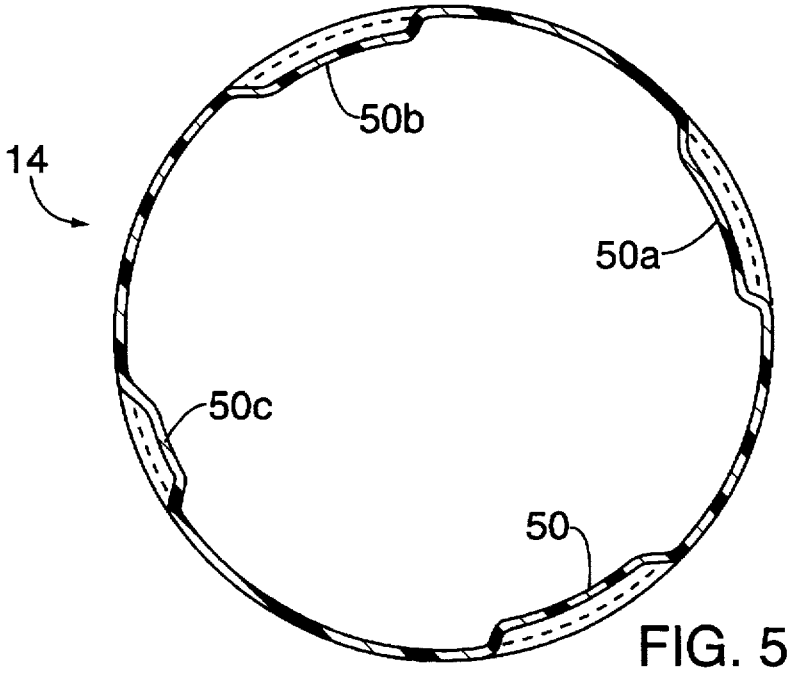
FIG. 5 is a cross sectional view of the top portion of the protective jacket taken along line 5—5 in FIG. 3.

Turning first to the jacket interlocking mechanism 17*a*, the bottom portion 12 of the protective jacket 10 comprises at least one locking passage 44 defined by a passage opening 46 which leads into a circumferential path 48 as best shown in FIGS. 1 and 4. In the embodiment illustrated in FIGS. 1 and 4, the circumferential path 48 has a small cavity 52 defined by the end 54 of the path 48 and a raised ramp-like ridge 56 disposed in the path 48. Referring to the passage 44 in FIG. 6, it will be seen that the ramp-like ridge 56 tapers outwardly from the passage opening 46 to form the cavity 52. The top portion 14 of the protective jacket comprises a male member projecting into the interior side of the top portion 14 as best shown in FIG. 5. The illustrated embodiment of the male member 50 is generally depicted as a lug, but it will be understood that other types of locking engagement may be used. For example, it will be understood that a sliding dovetail, cam and groove, ball and race, or other similar joining mechanisms may be used. The male member 50 is adapted to cooperatively engage the passage opening 46, and to slidably engage the path 40 in response to rotation of the top portion 14 relative to the bottom portion 12. Rotation of the top portion 14 relative to the bottom portion 12 causes the male member 50 to slide from the passage opening 46, toward the passage end 54, past the ridge 56, and into the cavity 52 which acts to resiliently and releasably lock the male member 50 in the passage 44. In order to insert the male member 50 into the cavity 52, the male member 50 and/or the ridge 56 must resiliently bend enough to permit the respective members to slide past each other. The male member 50 can be released from the passage 44 by rotating the male member 50 toward the passage opening 46. The engagement between the male member 50 and the passage 44 acts as a first means for releasably locking the top and bottom portions 14, 12 of the protective jacket 10 together. It will be appreciated that other embodiments may not have the raised projection or cavity. Similarly, other embodiments may have the passage and the male member disposed on the top and bottom portions of the jacket, respectively.

Figure 6:
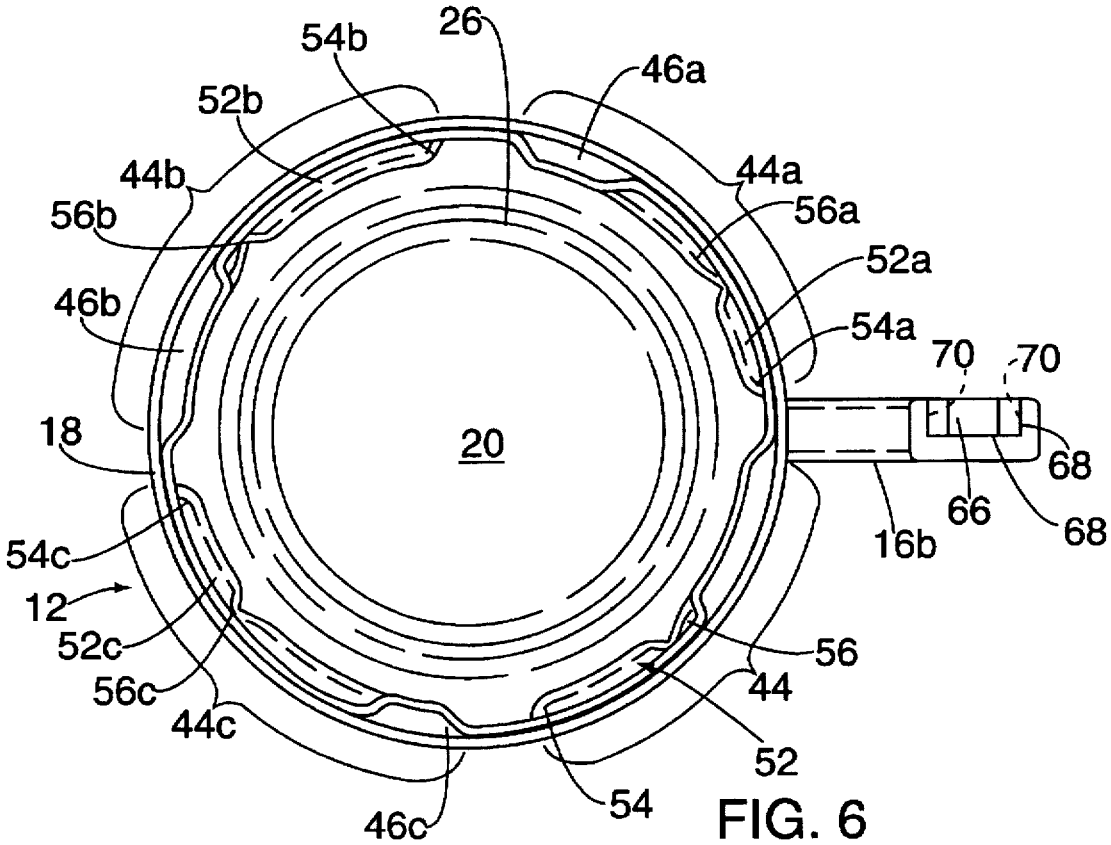
FIG. 6 is a cross sectional view of the bottom portion of the protective jacket taken along line 6—6 in FIG. 4.

Referring to the embodiment illustrated in FIGS. 1 and 4–5, it will be seen that the jacket interlocking mechanism 17*a* comprises four passages 44, 44*a*, 44*b*, 44*c* disposed on the bottom portion 12 which cooperate with four lugs 50, 50*a*, 50*b*, 50*c* respectively, disposed on the top portion 14. As best shown in FIG. 6, the four passages 44, 44*a*, 44*b*, 44*c* are generally disposed equidistantly around the circumference of the protective jacket 10.

It is desirable, but not required, that means be provided for properly aligning and orientating the bottom and top portions 12, 14 of the jacket 10 prior to rotation. In order to insure that the top and bottom portions 14, 12 are properly orientated during assembly, it is desirable that at least one of the passage openings, i.e., 46*c* (and its cooperating lug, i.e. 50*c*) be sized differently than the other three passage openings 46, 46*a*, 46*b* so that the bottom and top portions 12, 14 will only fit together when the opening 46*c* and its corresponding lug 50c are properly aligned. Thus, it will be seen in FIGS. 5–6 that three of the passage openings 46, 46*a*, 46*b* (and their corresponding lugs 50, 50*a*, 50*b*) are generally the same size while the fourth passage opening 46*c* and lug 50*c* are smaller. Another alignment and orientation means is to position one or all of the passages (and their corresponding lugs) eccentrically around the circumference of the jacket so that the lugs can only engage their corresponding passage openings when the bottom and top jacket portions are properly aligned. Other alignment methods will be known to those skilled in the art.

In accordance with certain objects of the invention, the protective jacket 10 is provided with a handle assembly 16 which can only be utilized if the bottom and top portions 12, 14 of the protective jacket 10 are properly locked together. The handle assembly 16, which is generally configured for strength and durability, comprises top and bottom handle portions 16*a*, 16*b* attached to the top and bottom portions 14, 12 of the protective jacket 10, respectively.

The top handle portion 16*a* is generally attached to the middle section 32 of the top jacket portion 14 and provides an added measure of protection to the vulnerable neck area B2 of the protected glass bottle B. The bottom handle portion 16*b* is generally attached to the body of the bottom portion 12. Either portion of the handle 16*a*, 16*b* may have reinforcement ribs including, for example, those generally depicted as 58 in connection with the bottom handle portion 16*b*.

Figure 7:
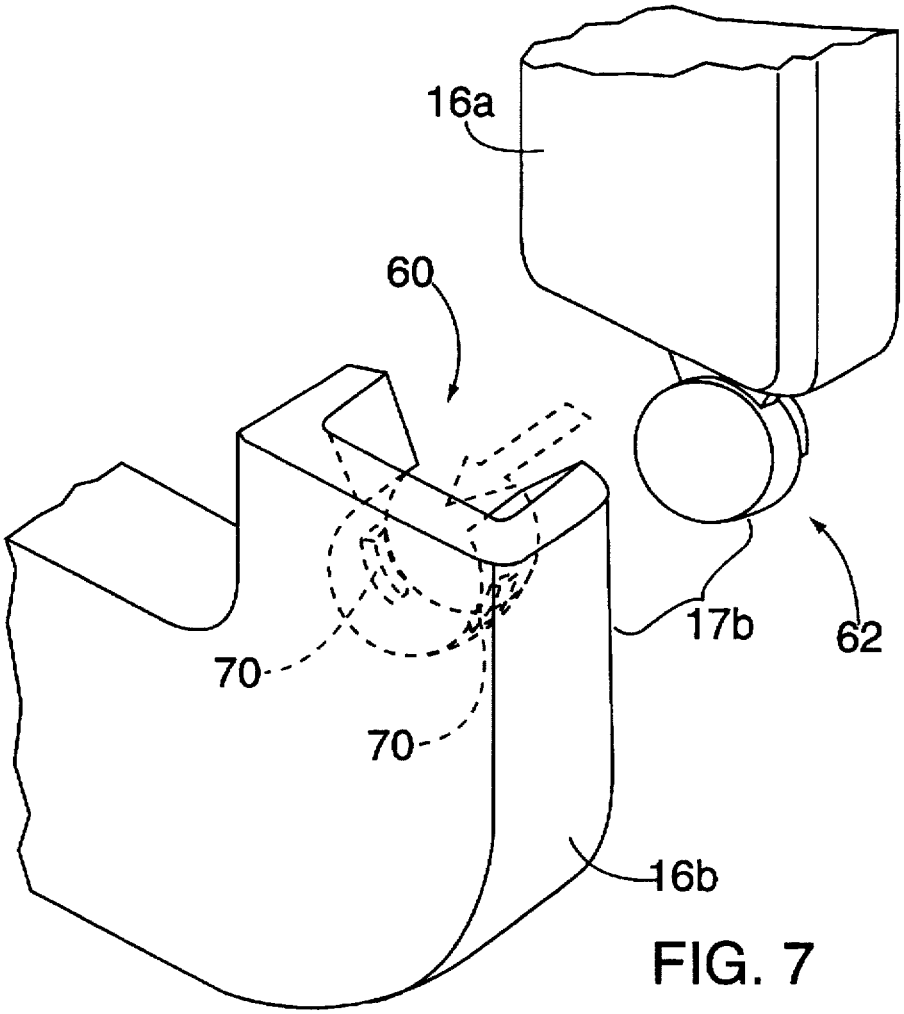
FIG. 7 is a partial exploded view illustrating the handle of the protective jacket.
Figure 8:
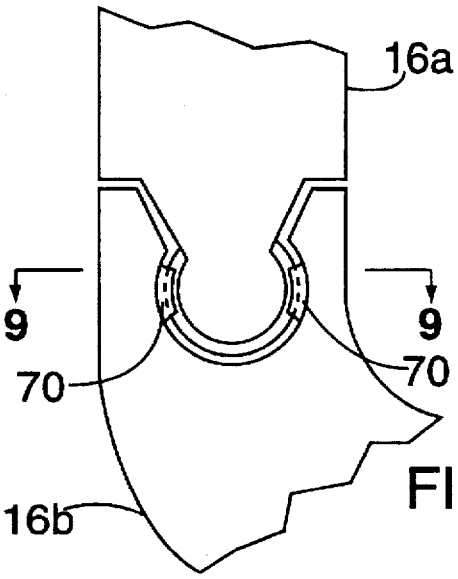
FIG. 8 is a partial elevational view illustrating the assembled handle of the protective jacket.
Figure 9:
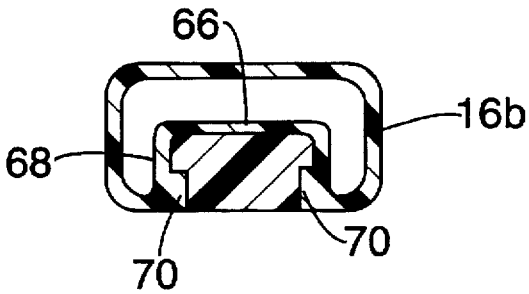
FIG. 9 is a cross sectional view of the handle of the protective jacket taken along line 9—9 in FIG. 8.

The top and bottom handle portions 16*a*, 16*b* have the handle interlocking mechanism 17*b* which may act as another part of the interlocking means. The handle interlocking mechanism 17*b* can be actuated in response to rotation between the bottom and top jacket portions 12, 14. Referring to FIGS. 7–9, it will be seen that the bottom handle portion 16*b* has a female connector 60 adapted to lockably receive a male connector 62 of the top handle portion 16*a*. The female connector 60 has a circular cavity 66 defined by cavity walls 68. At least a portion of the cavity walls 68 have opposing flanges 70 tapering inwardly toward the center of the cavity 66. The male connector 62 has a circular member 72 adapted to engage the cavity 66. The diameter of the male member 72 is slightly larger than the smallest distance between the flanges 70. In order to insert the male member 72 into the cavity 66, the flanges 70 must resiliently bend enough for the male member 72 to slide past the flanges 70. Thus, when the male connector 62 is slidably inserted into the female connector 60, the cavity 66 acts to resiliently receive the male member 72, providing "press fit" securement of the top and bottom handle portions 16*a*, 16*b*. Conversely, the operator can release and disengage the handle 16 by rotating the male connector 62 out of the female connector 60.

It should now be appreciated that the operator cannot use the handle 16 until and unless the interlocking means 17 is properly positioned to the locked position, thereby preventing the operator from using only the bottom portion 12 of the jacket for transporting the bottle B. In addition, although the illustrated embodiment of the interlocking means 17 comprises both the jacket and handle interlocking mechanisms 17*a*, 17*b*, it will be appreciated that other embodiments may utilize either jacket or the handle interlocking mechanism 17*a*, 17*b*.

The protective jacket 10 lends itself to either blow molding or injection molding or other acceptable manufacturing processes which will be known to those skilled in the art. The protective jacket 10 should be manufactured from shatter-resistant materials capable of withstanding the forces and loads exerted on the protective jacket 10. It is generally desirable that the protective jacket 10 be made of a generally translucent or transparent material so that the bottle B, the liquid level, and any labels may be viewed through the protective jacket 10. Examples of acceptable materials include plastic materials such as polyethylene, polypropylene, a combination of polyethylene and polypropylene, polyethylene terephalate (PET), polycarbonate or other materials which will be known to those in the art. A particular preferred material is a low density polyethylene. It is also preferable that the jacket be manufactured from a solvent-resistant material.

In order to assemble and operate the protective jacket 10, the circular insert 28 is placed into the bottom portion 12 of the jacket 10 so that it rests upon the base 20. The bottle B is slidably inserted into the bottom portion 12. Thereafter, the top portion 14 is slidably inserted onto the top of the bottle B so that the bottom neck B2 and opening protrude through the top portion's opening 36 and the top portion's circumferential edge 42 generally engages the bottom portion's circumferential edge 22. The bottom and top portions 12, 14 are rotated relative to each other so that the male members 50 disposed on the top portion 14 slidably engage the corresponding passage openings 46. Specifically, in the illustrated embodiment, the three large lugs 50, 50*a*, 50*b* engage the corresponding passages 46, 46*a*, 46*b* and the small lug 50*c* engages the small passage 46*c* to properly align the top and bottom portions 12, 14.

Figure 10:
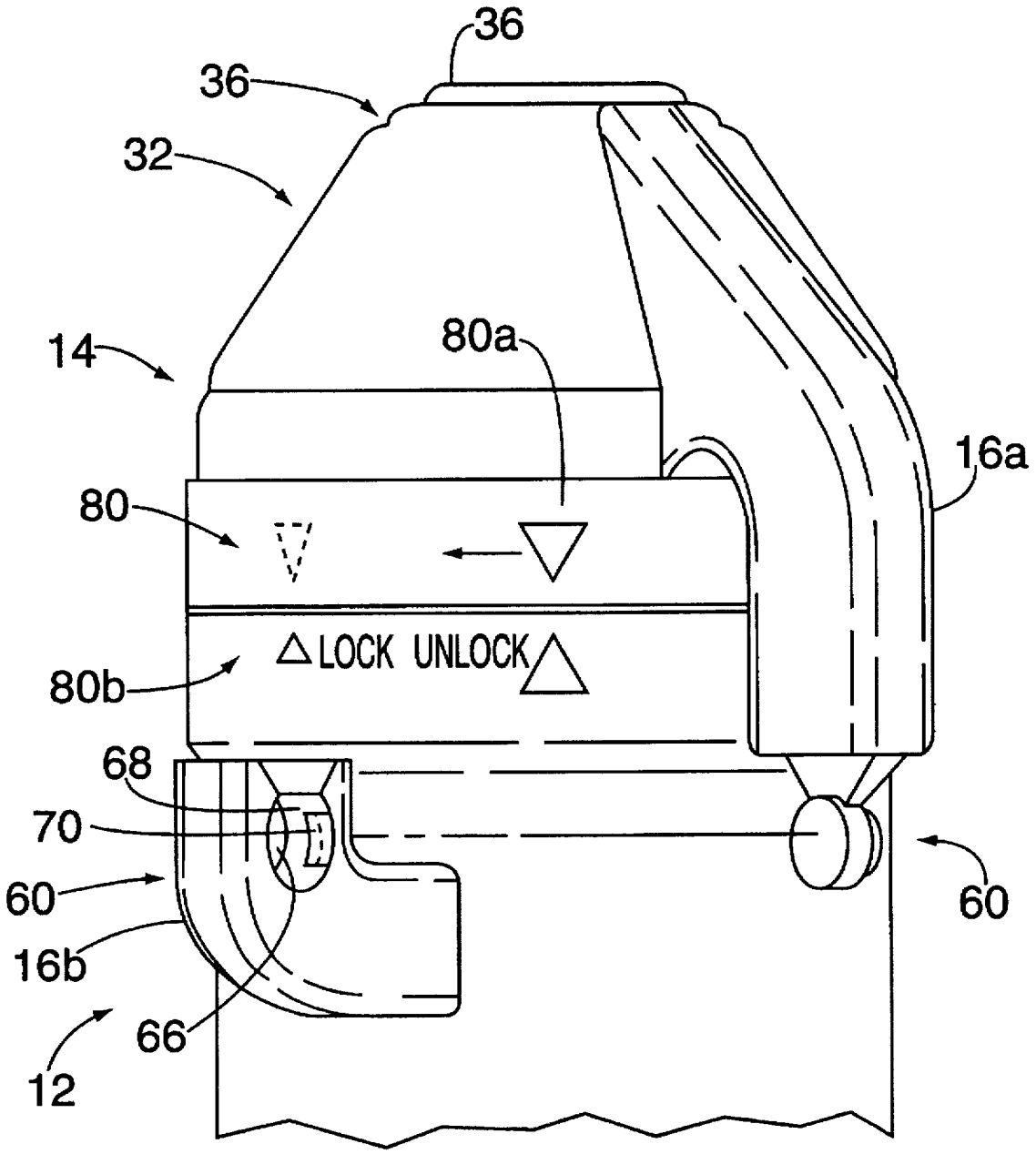
FIG. 10 is a partial perspective view of the protective jacket illustrating engagement between the top and bottom portions of the protective jacket.

In order to assist the operator in properly aligning the jacket portions 12, 14, the bottom and top portions 12, 14 may have graphic symbols 80 which indicate the proper orientation of the jacket portions as generally indicated in FIG. 10. FIG. 10 generally illustrates that the top and bottom portions 14, 12 may be rotated between an unlocked position 80*a* wherein the top and bottom portions 14, 12 are not securely attached to each other and a locked position 80*b* wherein the top and bottom portions 14, 12 securely engage each other.

Once the male members 50 properly engage the passage openings 46, the top and bottom portions 14, 12 may be rotated relative to each other toward the locked position. In response to the rotation, it will be appreciated that the male member 50 disposed within the path 48, will slide past the ridge 56, and into the cavity 52. Simultaneously, the top handle portion 16*a* will rotate into engagement with the bottom handle portion 16*b* such that the male connector 62 securely and lockably engages the female connector 60.

It should be appreciated that the protective jacket 10 in accordance with the present invention can be easily and quickly assembled or disassembled. Since the interior configuration and dimensions of the protective jacket 10 closely engage the exterior of the bottle B, it will also be appreciated that the bottle B is snugly carried by the safety jacket 10 so that the operator can transport the safety jacket 10 and bottle B. In addition, the operator can use the safety jacket 10 to tilt the bottle B to pour and dispense the bottle's contents with little relative slippage between the bottle B and the safety jacket 10.

Thus, it will be seen that a novel and improved protective jacket has been provided which attains the aforenoted objects. Various additional modifications of the embodiments specifically illustrated and described herein will be apparent to those skilled in the art, particularly in light of the teachings of this invention.

We claim as our invention:

1. A protective jacket for transporting a container, the container having upper and lower portions and an opening for filling and emptying the container, the protective jacket comprising:

a bottom jacket portion having a base and walls projecting upwardly from the base for receiving and protecting the lower portion of the container, a top jacket portion having walls for covering the upper portion of the container, means for selectively and releasably interlocking the bottom and top jacket portions together, the interlocking means comprising a male member disposed on one of the bottom and top jacket portions, a passage disposed on the other of the bottom and top jacket portions for slidably receiving the male member between an unlocked and locked position in response to rotation of the top and bottom jacket portions, wherein the passage lockably receives the male member and attaches the top and bottom jacket portions together in the locked position and wherein the male member does not lockably engage the passage in the unlocked position, one end of the passage having a passage opening for receiving the male member when the top and bottom jacket portions engage each other, another end of the passage having a ridge defining a cavity for securely receiving the male member in response to rotation of the bottom and to jacket portions, wherein at least one of the ridge and male members is resilient to permit the male member and ridge to slide past each other the ridge releasably securing the male member in the cavity and preventing unintentional movement of the male member away from the cavity when the top and bottom jacket portions are in the locked position, and a handle for transporting the jacket and container, the handle having a top handle portion attached to the top jacket portion and a bottom handle portion attached to the bottom jacket portion such that the top and bottom handle portions slidably engage each other in a circumferential direction when the interlocking means is positioned towards the locked position.

2. The protective jacket as set forth in claim 1 wherein the protective jacket is composed of solvent and shatter-resistant polymeric composition.

3. The protective jacket as set forth in claim 1 wherein the protective jacket is composed of a polymeric material permitting the container to be viewed therethrough.

4. The protective jacket as set forth in claim 1 wherein the bottom and top portions are configured to conform closely to the shape of the container to be protected.

5. The protective jacket as set forth in claim 1 wherein the top portion comprises an opening for providing access to the contents of the container without requiring separation of the bottom and top portions.

6. The protective jacket as set forth in claim 1 wherein the base comprises a substantially flat surface disposed inboard of the walls of the bottom jacket portion.

7. The protective jacket as set forth in claim 6 wherein a peripheral edge of the base is defined by reinforcement channels enabling the base to safely withstand shocks exerted on the jacket.

8. The protective jacket as set forth in claim 1 comprising an insert adapted for engaging the base and for spacing the container from direct contact with the base to minimize transmission of shocks exerted on the base to the container.

9. A protective jacket for transporting a bottle, the bottle having upper and lower portions and an opening for filling and emptying the bottle, the protective jacket comprising:

a bottom jacket portion having a base, walls projecting upwardly from the base for receiving and protecting the lower portion of the bottle, and a top circumferential edge, a top jacket portion having walls for covering the upper portion of the bottle, and a top circumferential edge adapted for rotatably engaging the bottom circumferential edge, a handle having top and bottom handle portions attached to the top and bottom jacket portions respectively, means for selectively and releasably interlocking the bottom and top jacket portions together in response to rotation of the top and bottom jacket portions between locked and unlocked positions, the interlocking means comprising a male connector disposed on one of the bottom and top handle portions, a female connector disposed on the other of the bottom and top handle portions for slidably receiving the male connector in response to rotation of the top and bottom jacket portions, wherein the female connector lockably receives the male connector and attaches the top and bottom jacket portions together in the locked position and wherein the female and male connectors do not lockably engage in the unlocked position such that the top and bottom jacket portions may be removed.

10. The protective jacket as set forth in claim 9 wherein at least one of the male and female connectors is resilient to permit the male and female connectors to slide past each other when the top and bottom handle portions are rotated into engagement with each other.

11. The protective jacket as set forth in claim 9 wherein the female connector has a cavity defined by cavity walls and a flange projecting outwardly from the cavity walls and the male connector has a latch member configured to lockably engage the cavity.

12. The protective jacket as set forth in claim 11 wherein at least one of the flange and the latch member is resilient to permit the latch member and flange connectors to slide past each other when the top and bottom handle portions are rotated into engagement with each other.

13. The protective jacket as set forth in claim 9 wherein the interlocking means comprises a male member disposed on one of the bottom and top jacket portions, a passage disposed on the other of the bottom and top jacket portions for slidably receiving the male member between an unlocked and locked position in response to rotation of the top and bottom portions, wherein the passage lockably receives the male member and attaches the top and bottom jacket portions together in the locked position and wherein the male member does not lockably engage the passage in the unlocked position.

14. The protective jacket as set forth in claim 13 wherein one end of the passage has a passage opening for receiving the male member when the top and bottom jacket portions engage each other and another end of the passage has a cavity for securely receiving the male member in response to rotation of the bottom and top jacket portions.

15. The protective jacket as set forth in claim 14 wherein the passage has a ridge disposed between the cavity and the passage opening for releasably securing the male member in the cavity.

16. The protective jacket as set forth in claim 9 wherein the protective jacket is composed of solvent and shatter-resistant polymeric composition.

17. The protective jacket as set forth in claim 9 wherein the protective jacket is composed of a polymeric material permitting the container to be viewed therethrough.

18. The protective jacket as set forth in claim 9 wherein the bottom and top jacket portions are configured to conform closely to the shape of the bottle to be protected.

19. The protective jacket as set forth in claim 9 wherein the top jacket portion comprises an opening for providing access to the contents of the bottle without requiring separation of the bottom and top jacket portions.

20. The protective jacket as set forth in claim 9 wherein the base comprises a substantially flat surface disposed inboard of the walls of the bottom jacket portion.

21. The protective jacket as set forth in claim 20 wherein a peripheral edge of the base is defined by reinforcement channels enabling the base to safely withstand shocks exerted on the jacket.

22. The protective jacket as set forth in claim 9 comprising an insert adapted for engaging the base and for spacing the bottle from direct contact with the base to minimize transmission of shocks exerted on the base to the bottle.

23. A protective jacket for transporting a container, the container having upper and lower portions and an opening for filling and emptying the container, the protective jacket comprising:

a bottom jacket portion having a base and walls projecting upwardly from the base for receiving and protecting the lower portion of the container, a top jacket portion having walls for covering the upper portion of the container, means for selectively and releasably interlocking the bottom and top jacket portions together, the interlocking means comprising a male member disposed on one of the bottom and top jacket portions, a passage disposed on the other of the bottom and top jacket portions for slidably receiving the male member between unlocked and locked positions in response to rotation of the top and bottom jacket portions, wherein the passage lockably receives the male member and attaches the top and bottom jacket portions together in the locked position and wherein the male member does not lockably engage the passage in the unlocked position, one end of the passage having a passage opening for receiving the male member when the top and bottom jacket portions engage each other, another end of the passage having a cavity for securely receiving the male member in response to rotation of the bottom and top jacket portions, and a ridge disposed in the passage between the cavity and the passage opening, wherein at least one of the ridge and male members is resilient to permit the male member and ridge to slide past each other the rid e when the to and bottom jacket portions are in the locked position, releasably securing the male member in the cavity and preventing unintentional movement of the male member away from the cavity, and a handle for transporting the jacket and container, the handle having a top handle portion attached to the top jacket portion and a bottom handle portion attached to the bottom jacket portion, wherein the top and bottom handle portions engage each other when the interlocking means is positioned towards the locked position.

24. A protective jacket for transporting a bottle, the bottle having upper and lower portions and an opening for filling and emptying the bottle, the protective jacket comprising:

a bottom jacket portion having a base, walls projecting upwardly from the base for receiving and protecting the lower portion of the bottle, and a top circumferential edge, a top jacket portion having wails for covering the upper portion of the bottle, and a top circumferential edge adapted for rotatably engaging the bottom circumferential edge, a handle having top and bottom handle portions attached to the top and bottom jacket portions respectively, means for selectively and releasably interlocking the bottom and top jacket portions together in response to rotation of the top and bottom jacket portions between locked and unlocked positions, the interlocking means comprising a male connector disposed on one of the bottom and top handle portions, a female connector disposed on the other of the bottom and top handle portions for slidably receiving the male connector in response to rotation of the top and bottom jacket portions, wherein the female connector lockably receives the male connector and attaches the top and bottom jacket portions together in the locked position and wherein the female and male connectors do not lockably engage in the unlocked position such that the top and bottom jacket portions may be removed and the handle may not be used to carry the bottom jacket portion.

25. A protective jacket for transporting a bottle, the bottle having upper and lower portions and an opening for filling and emptying the bottle, the protective jacket comprising:

a bottom jacket portion having a base, walls projecting upwardly from the base for receiving and protecting the lower portion of the bottle, and a top circumferential edge, a top jacket portion having walls for covering the upper portion of the bottle, and a top circumferential edge adapted for rotatably engaging the bottom circumferential edge, a handle having top and bottom handle portions attached to the top and bottom jacket portions respectively, means for selectively and releasably interlocking the bottom and top jacket portions together in response to rotation of the top and bottom jacket portions between locked and unlocked positions, the interlocking means comprising a male connector disposed on one of the bottom and top handle portions, a female connector disposed on the other of the bottom and top handle portions for slidably receiving the male connector in response to rotation of the top and bottom jacket portions, wherein the female connector lockably receives the male connector and attaches the top and bottom, jacket portions together in the locked position and wherein the female and male connectors do not lockably engage in the unlocked position such that the top and bottom jacket portions may be removed, the interlocking means further comprising a male member disposed on one of the bottom and top jacket portions, a passage disposed on the other of the bottom and top jacket portions for slidably receiving the male member between an unlocked and locked position in response to rotation of the top and bottom jacket portions, wherein the passage lockably receives the male member and attaches the top and bottom jacket portions together in the locked position and wherein the male member does not lockably engage the passage in the unlocked position.

26. A protective jacket for transporting a container, the container having upper and lower portions and an opening for filling and emptying the container, the protective jacket comprising:

a bottom jacket portion having a base and walls projecting upwardly from the base for receiving and protecting the lower portion of the container, a top jacket portion having walls for covering at least a portion of the upper portion of the container, a connector for selectively and releasably interlocking the bottom and top jacket portions together, the connector comprising a male member disposed on one of the bottom and top jacket portions, a passage disposed on the other of the bottom and top jacket portions for slidably receiving the male member between an unlocked and locked position in response to rotation of the top and bottom jacket portions, wherein the passage lockably receives the male member and attaches the top and bottom jacket portions together in the locked position and wherein the male member does not lockably engage the passage in the unlocked position, one end of the passage having a passage opening for receiving the male member when the top and bottom jacket portions engage each other, another end of the passage having a ridge defining a cavity for securely receiving the male member in response to rotation of the bottom and top jacket portions, wherein at least one of the ridge and male members is resilient to permit the male member and ridge to slide past each other, the ridge releasably securing the male member in the cavity and preventing unintentional movement of the male member out of the cavity when the top and bottom jacket portions are in the locked position, and a handle for transporting the jacket and container, the handle having a top handle portion attached to the top jacket portion and a bottom handle portion attached to the bottom jacket portion wherein the top and bottom handle portions slidably engage each other in a circumferential direction when the connector is positioned towards the locked position, so that the top and bottom handle portions join to form a unitary handle only when the top jacket portion is interlocked with the bottom jacket portion.

27. The protective jacket as set forth in claim 26, wherein the protective jacket is shatter resistant.

28. The protective jacket as set forth in claim 26, wherein the protective jacket is at least partially transparent.

* * * * *

UNITED STATES PATENT AND TRADEMARK OFFICE

CERTIFICATE OF CORRECTION

PATENT NO : 5,704,484
DATED : January 6, 1998
INVENTOR(S) : Spinks et al.

It is certified that error appears in the above-identified patent and that said Letters Patent are hereby corrected as shown below:

Claim 1, line 27, replace "to" with -- top --.

Claim 23, line 31, replace "rid e" with -- ridge --.

Claim 23, line 31, replace "to" with -- top --.

Claim 24, line 8, replace "wails" with -- walls --.

Signed and Sealed this

Seventh Day of March, 2000

*Attest:*

*Attesting Officer*

Q. TODD DICKINSON

*Commissioner of Patents and Trademarks*